US006679653B1

(12) United States Patent
DiTullio

(10) Patent No.: US 6,679,653 B1
(45) Date of Patent: Jan. 20, 2004

(54) LEACHING OR DRAINAGE GALLERY WITH INCREASED SURFACE AREA

(75) Inventor: Robert J. DiTullio, Warren, CT (US)

(73) Assignee: Cultec, Inc., Brookfield, CT (US)

( * ) Notice: Subject to any disclaimer, the term of this patent is extended or adjusted under 35 U.S.C. 154(b) by 0 days.

(21) Appl. No.: 10/233,944

(22) Filed: Sep. 3, 2002

(51) Int. Cl.[7] ..... E02B 13/00
(52) U.S. Cl. ..... 405/49; 405/46; 405/45
(58) Field of Search ..... 405/49, 48, 47, 405/46, 45, 44, 43, 36, 52, 53

(56) References Cited

U.S. PATENT DOCUMENTS 4,182,583 A * 1/1980 McEntyre ..... 405/48
4,360,042 A * 11/1982 Fouss et al. ..... 405/49
4,523,613 A * 6/1985 Fouss et al. ..... 405/49
4,759,661 A * 7/1988 Nichols et al. ..... 405/48
4,950,103 A * 8/1990 Justice ..... 405/43
5,087,151 A 2/1992 DiTullio ..... 405/43
5,954,451 A * 9/1999 Presby ..... 405/49
6,461,078 B1 * 10/2002 Presby ..... 405/49

* cited by examiner

*Primary Examiner*—Frederick L. Lagman
(74) *Attorney, Agent, or Firm*—St. Onge Steward Johnston & Reens LLC

(57) ABSTRACT

A gallery for guiding liquid through a leaching or drain field and allowing liquid to seep into adjacent ground is provided. The gallery includes an elongated main body portion having an undulating wall defined by a plurality of laterally spaced apart ribs, the undulating wall defining an outer surface and an interior space for liquid and particles to flow therethrough. A plurality of area enhancing elements are formed on the outer surface of the undulating wall for increasing a surface area of the outer surface to promote the growth and flourishing of the bacteria and other microorganisms on the outer surface.

15 Claims, 4 Drawing Sheets

LEACHING OR DRAINAGE GALLERY WITH INCREASED SURFACE AREA

FIELD OF THE INVENTION

The present invention relates generally to septic systems, and more particularly to a leaching or drainage system for a septic system which uses lightweight, molded gallery structures to form a leaching field that facilitates distribution of effluent and particles, which gallery structures are provided with a maximized surface area to promote the growth of various desirable microorganisms.

BACKGROUND OF THE INVENTION

In terms of volume, most of the water used in households around the United States is employed to carry off wastes, most of these wastes being organic and inorganic solids. Larger volumes of water are used for washing dishes, bathing and flushing the toilet than for drinking, cooking, washing cars, etc.

In urban areas, wastes carried by water from kitchens, bathrooms and laundry rooms are collected in a sewer system and transported to central sewage treatment plants. In rural areas and in unsewered suburban residential areas, individual septic systems are used to treat household waste. There are millions of such septic systems presently in use and being built in the United States. If properly designed, installed and adequately maintained, such a septic system will serve a household satisfactorily to treat household wastes.

In use, a septic system will condition household water carrying dirt, detergents, discarded food scraps and body wastes so that water may be readily percolated into the sub-soil of the surrounding ground. A typical septic system is comprised of a rectangular precast cement septic tank buried in the ground having a leaching or drain field extending therefrom. Household wastes or sewage flows to the septic tank under the influence of gravity from the house via a sewer line or pipe. The septic tank is a large, watertight and light-tight container in which the organic solids found in the sewage are decomposed by natural bacterial processes. Once the sewage is introduced into the tank, large solid particles sink, forming a sludge at the bottom of the tank while smaller, lighter particles as well as oils and greases rise to the surface forming a scum layer over a volume of liquid material located between the sludge and scum layers. Bacteria and other microorganisms in the tank break down and reduce the volume of the solids and scum. The bacteria cannot attack some of the material introduced into the system such as stone particles, plastic, etc. and these materials must be removed from the tank by periodic tank cleanings.

An outlet pipe is provided in the tank permitting some of the liquid material known as effluent to flow via hydrostatic pressure from the tank. The effluent still contains some decomposed solids as well as bacteria and other microorganisms found in the tank and flows into an adjoining leaching or drain field where it must be permitted to percolate through the surrounding ground.

The leaching field has traditionally been a trench in the ground about eighteen inches wide filled with gravel. A four inch perforated pipe is located in the trench surrounded by the gravel. Laid over the gravel and the pipe is a layer of tar paper, salt hay or woven plastic cloth with a layer of top soil placed thereover. The pipe is set at an appropriate pitch to permit a desired flow of the effluent therealong under the influence of gravity. In use, the effluent runs down the perforated pipe from one end of the pipe to the other and flows out the apertures therein into the surrounding gravel and eventually into the surrounding ground.

Another type of leaching field is formed of precast concrete galleries which create space underground within a gravel bed to increase the volume of the field. These galleries are made in different shapes (rectangular, triangular) and are ideal for situations where there is insufficient area for the traditional pipe and gravel systems.

Some of the drawbacks of the traditional septic systems are that the septic tanks and leaching galleries have been made from precast concrete and are extremely heavy requiring heavy construction equipment to put them in place. In the leaching fields, the gravel used in constructing them is difficult to work with and expensive. It also tends to settle and reduces the overall volume of the trench by as much as 75%.

Attempts have been made to overcome the limitations that are attendant upon the use of traditional septic systems. U.S. Pat. No. 5,087,151 to DiTulio ("the '151 patent"), which represents one such attempt, discloses a drainage and leaching field system comprising vacuum-molded polyethylene galleries that are designed to be connected and locked together in an end-to-end fashion. The galleries comprise a series of pre-molded polyethylene bodies with an arch-shaped configuration having upstanding ribs running transverse to the length of the gallery. The ribs provide compressive strength to the gallery so as to inhibit crushing of the gallery by the weight of earth under which it is buried, as well as the weight of persons, vehicles, etc. which pass over the buried gallery.

While the drainage and leaching field system disclosed in the '151 patent provides numerous benefits over traditional systems, including the provision of a lightweight, easy to install and structurally sound system, the system disclosed in the '151 has been improved upon, which improvements form the basis of the present invention. More specifically, it has been recognized that the beneficial decomposition of waste materials does not immediately end when effluent leaves the septic tank. Rather, when the effluent leaves the tank and flows into the adjoining leaching or drain field it still contains some decomposed solids as well as bacteria and other microorganisms found in the tank. Thus, beneficial decomposition can continue to take place in the leaching or drain field before the effluent percolates through the surrounding ground. For this reason, it would be desirable to promote the growth and flourishing of the bacteria and other microorganisms entering the leaching or drain field.

While the beneficial bacteria and other microorganisms may be free-floating in the effluent as it leaves the tank, they typically thrive when attached to a surface. As such, it has been recognized that the greater the area of surfaces provided within the leaching or drain field to which the bacteria and other microorganisms can attach themselves, the greater the number of thriving bacteria and microorganisms that can be maintained. Even though the '151 patent discloses a series of galleries, each of which includes a plurality upstanding reinforcing ribs running transverse to the length thereof, which arrangement does provide a somewhat large surface area for accommodating bacteria and other microorganisms, an even larger surface area would be even more desirable.

What is desired, therefore, is a leaching field system which employs lightweight vacuum-molded polyethylene gallery structures to form the leaching field, which may be readily and economically fabricated and will enjoy a long life in operation, which is resistant to being crushed by weight above it, which promotes the growth and flourishing of the bacteria and other microorganisms entering the leaching field, and which is provided with a maximized surface area to so promote the growth and flourishing of the bacteria and other microorganisms.

SUMMARY OF THE INVENTION

Accordingly, it is an object of the present invention to provide a leaching field system which employs lightweight vacuum-molded polyethylene gallery structures to form the leaching field.

Another object of the present invention is to provide a leaching field system having the above characteristics and which may be readily and economically fabricated and will enjoy a long life in operation.

A further object of the present invention is to provide a leaching field system having the above characteristics and which is resistant to being crushed by weight above it.

Still another object of the present invention is to provide a leaching field system having the above characteristics and which promotes the growth and flourishing of the bacteria and other microorganisms entering the leaching field.

Yet a further object of the present invention is to provide a leaching field system having the above characteristics and which is provided with a maximized surface area to so promote the growth and flourishing of the bacteria and other microorganisms.

These and other objects of the present invention are achieved by provision of a gallery for guiding liquid through a leaching or drain field and allowing liquid to seep into adjacent ground. The gallery includes an elongated main body portion having an undulating wall defined by a plurality of laterally spaced apart ribs, the undulating wall defining an outer surface and an interior space for liquid and particles to flow therethrough. A plurality of area enhancing elements are formed on the outer surface of the undulating wall for increasing a surface area of the outer surface to promote the growth and flourishing of the bacteria and other microorganisms on the outer surface.

The undulating wall of the gallery preferably has a plurality of holes passing therethrough for allowing liquid and particles to escape from the interior space into the leaching or drain field. The area enhancing elements may comprise protuberances, dimples, surface texturing or a combination of two or more of such elements. Moreover, the area enhancing elements may comprise regular geometric shapes, such hemispherical, semispherical, polyhedral, conical and/or frustoconical shapes, or may comprise irregular shapes. Furthermore, the area enhancing elements may all be of substantially the same size or may be randomly sized, and may be regularly or randomly spaced.

In another aspect, a method for creating such an above-described gallery is provided.

The invention and its particular features and advantages will become more apparent from the following detailed description considered with reference to the accompanying drawings.

DETAILED DESCRIPTION OF AN EMBODIMENT OF THE INVENTION

Figure 1:
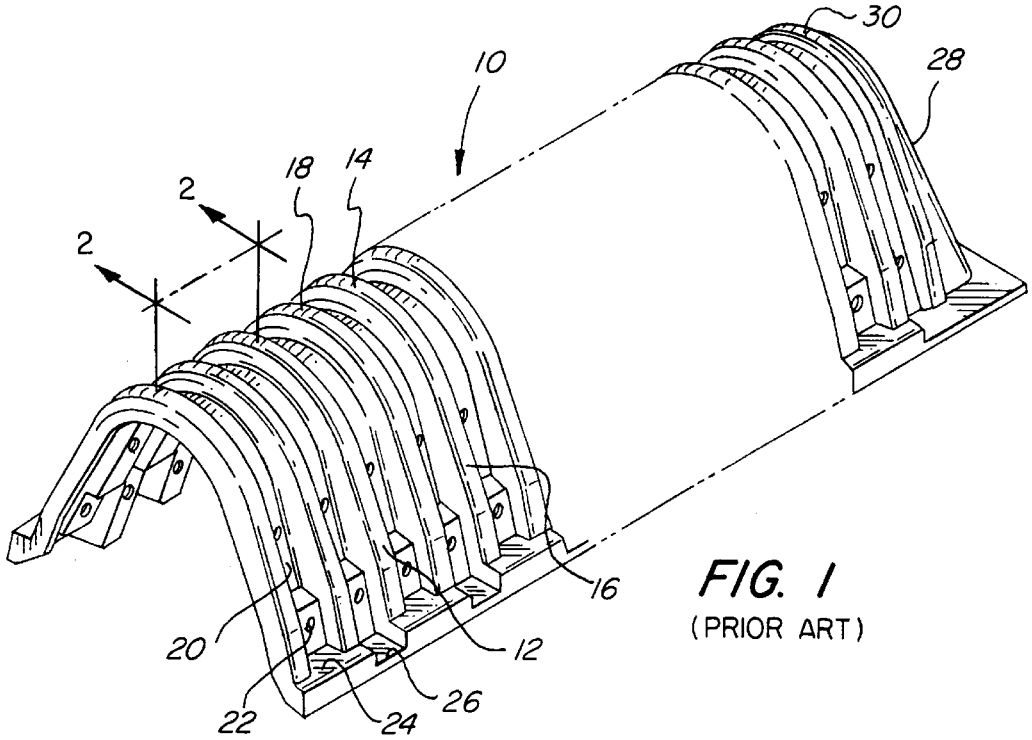
FIG. 1 (PRIOR ART)
FIG. 1 is a perspective view of a prior art vacuum-molded polyethylene gallery structure.
Figure 2:
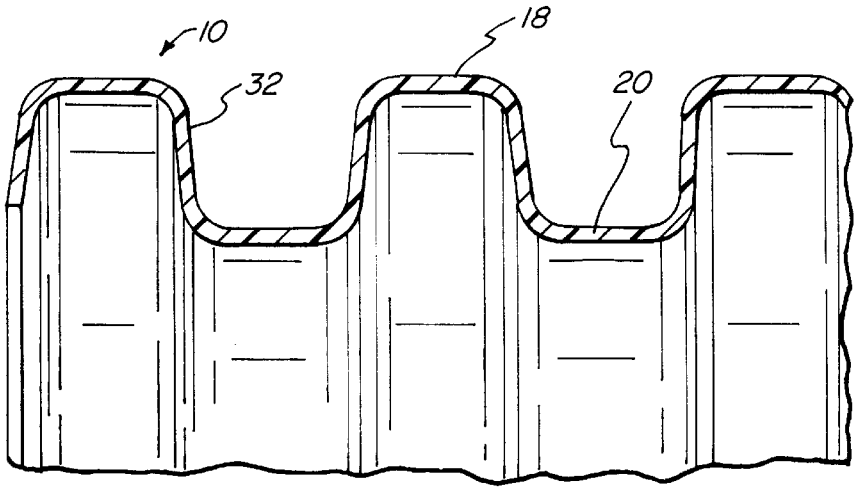
FIG. 2 (PRIOR ART)
FIG. 2 is an enlarged, partially cross-sectional view of a portion of the prior art vacuum-molded polyethylene gallery structure taken along line 2—2 of FIG. 1.

Referring first to FIGS. 1 and 2, a prior art vacuum-molded polyethylene gallery structure 10 used for constructing an underground leaching or drain field is shown. The gallery structure 10 forms an enclosure and has an arched or trapezoidal shape with an open bottom. The arched or trapezoidal shape allows for molding draft and nesting type stacking. The gallery 10 is formed by a main body portion 12 having a top wall 14 and two downwardly inclined sidewalls 16. When gallery 10 is arch-shaped, top wall 14 and sidewalls 16 for a continuous arch at a top thereof.

The main body portion 12 has a corrugated configuration with a plurality of upstanding, laterally extending ribs members 18 spaced longitudinally therealong. In between adjacent ribs 18 are a plurality of vertical infiltration walls 20. Each of the infiltration walls 20 includes at least one infiltration aperture 22 formed therein for permitting effluent to drain from the interior of the leaching gallery 10. The sidewalls 16 also include nesting lugs 24 which allow the gallery 10 to be nested with other similar galleries without firmly locking thereto and facilitating separation thereof.

The sidewalls 16 of the main body portion 12 terminate at base portions 26 extending longitudinally along the lower portion thereof. The base portions 26 are designed to support the gallery 10 on the ground. An inclined end wall 28 is located on an end of the main body portion 12 of the gallery 10 to provide further structural support. End wall 28 may include an opening (not shown) to act as an inlet to the gallery which receives a drainpipe (not shown). In other non-illustrated embodiments, the opening may be omitted, or a knockout panel may be provided for easy positioning of an opening.

Gallery 10 may be attached to adjacent galleries by one of numerous methods, as more fully described in the '151 patent, which is hereby incorporated in its entirety by reference. In the illustrated embodiment attachment is accomplished by providing a rib 30 adjoining the end wall 28 of the gallery 10 which is slightly smaller in height and width than the remaining ribs 18 thereon. To achieve attachment, gallery 10 is lifted and dropped to securely latch with an adjoining identical gallery with rib 18 adjoining the open end of gallery 10 seating on smaller rib 30. The end wall 28 from one gallery provides support for both galleries in the attachment area.

In an exemplary method of constructing the leaching or drain field, a trench is dug by a backhoe and the plurality of galleries, which have preferably been conveniently brought to the construction site in a nested condition in the bed of a pickup truck or the like, are positioned on the bottom of the trench in end-to-end relationship. The galleries make it unnecessary to put crushed stone at the bottom of the trench so they may rest directly on the ground, or a bed of crushed stone may be provided in the trench. The adjoining galleries are lifted and dropped onto one another using the procedure described above in order to couple all the galleries one to another. An infeed drainpipe is passed through the openings in at least one end wall. The drainpipe can extend a short distance into the gallery or it can be a perforated pipe extending entirely through the length of the gallery. To complete the installation, crushed stone is added to the trench to permit lateral leaching and finally the entire structure is covered by a layer of tar paper, salt hay or woven plastic cloth and topsoil. Any number of galleries can be used to form the leaching field and the galleries can be set up in series or in parallel arrangement. The purpose of the galleries is to provide additional volume to the leaching field without using concrete forms or large amounts of heavy, expensive, hard-to-work-with crushed stone.

The galleries 10 are preferably one-piece vacuum formed units integrally molded from a plastic resin such as rugged high density polyethylene but it should be apparent to those skilled in the art that it may be manufactured from other suitable materials which would not be adversely influenced by household sewage effluent, gases, chemicals in sewage or soil chemicals and would not rust, corrode, crack or decay.

A drain or leaching field as described above can typically be installed in one-third to one-half the time required for traditional systems. Each gallery unit can be installed by hand by one or two individual workmen and requires no heavy equipment which makes it especially suitable for installation in remote locations. This also reduces the chance of serious injury encountered in concrete installations that require cable and chain lifting and positioning by heavy equipment.

However, as described more fully above, these known galleries may not provide adequate surface area to support the desired number of beneficial bacteria and other microorganisms. More specifically, as best seen in FIG. 2, ribs 18 and the infiltration walls 20 therebetween of prior art galleries have defined an outer surface 32 which, while undulating, is relatively smooth. I have concluded that if the surface area of outer surface 32 is increased, more beneficial bacteria and other microorganisms can be sustained, providing a more efficient processing of household waste.

Referring now to FIGS. 3–7, a gallery structure 10' used for constructing an underground leaching or drain field in accordance with the present invention is shown. As gallery structure 10' is similar in many respects to gallery structure 10 described above with respect to FIGS. 1 and 2, similar elements are referenced by similar designations, and a detailed description of similar elements is not again presented.

The main novel feature of gallery structure 10' over gallery 10 is that the outer surface 32' defined by ribs 18' and the infiltration walls 20' therebetween is not only undulating, but also includes a plurality of surface area enhancing elements 34. Surface area enhancing elements 34 may take many forms, such as protuberances 36 protruding from outer surface 32' (see FIGS. 4, 6 and 7), dimples 38 formed in outer surface 32' (see FIG. 5) or a combination of protuberances 36 and dimples 38, so long as surface area enhancing elements 34 cause outer surface 32' to have a larger surface area than it would without the presence of such surface area enhancing elements 34.

Figure 4:
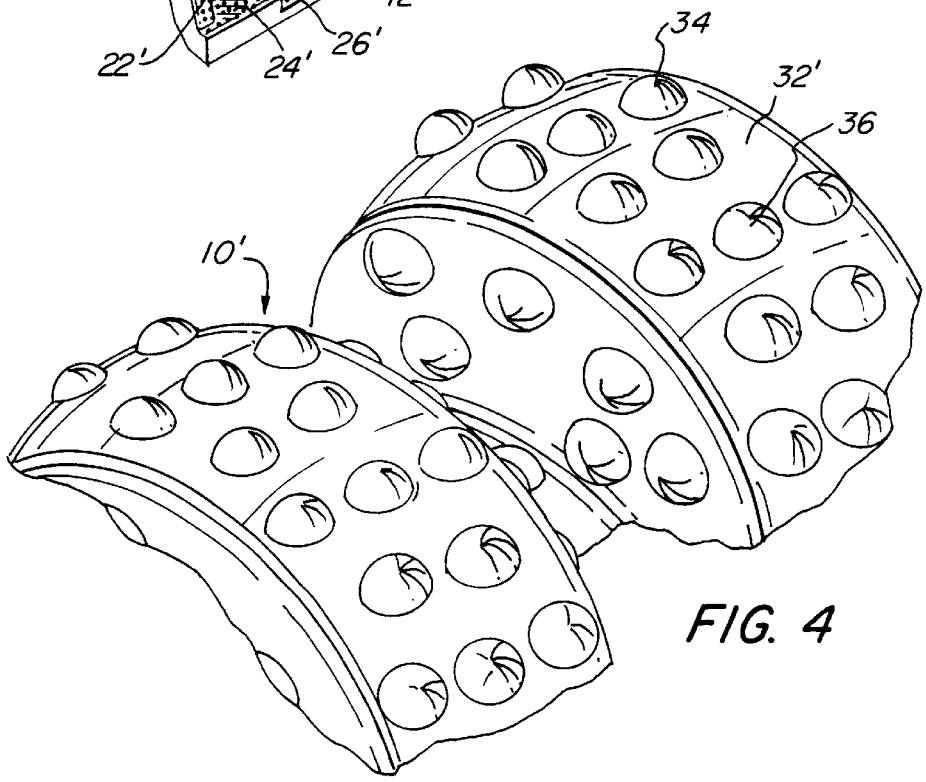
FIG. 4 is an enlarged perspective view showing in more detail one embodiment of the vacuum-molded polyethylene gallery structure of FIG. 3.
Figure 5:
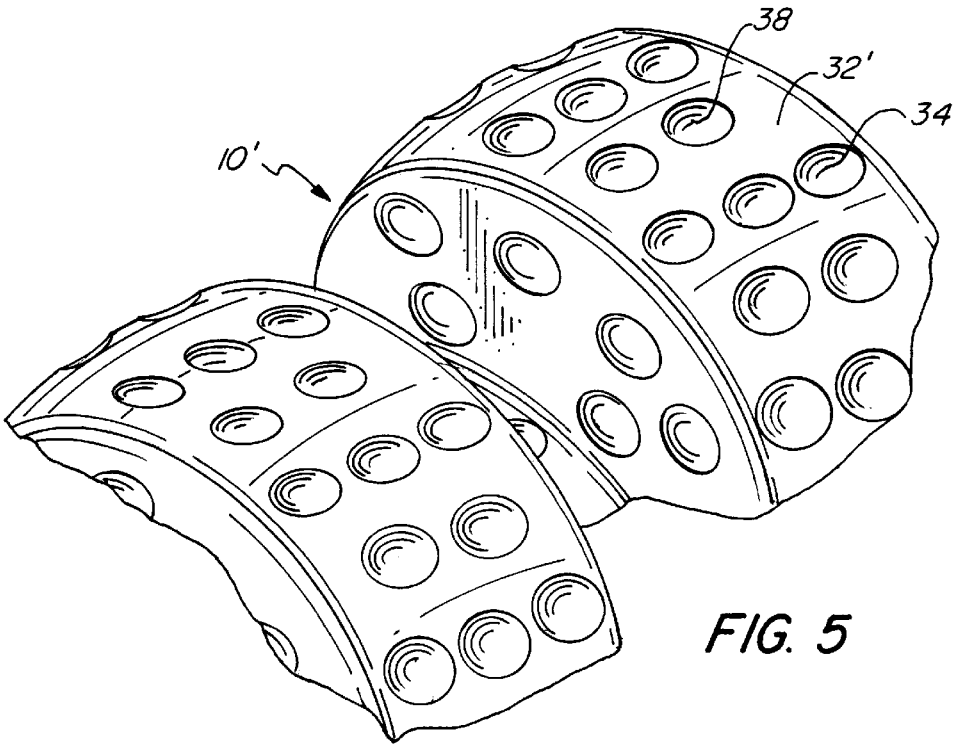
FIG. 5 is an enlarged perspective view showing in more detail another embodiment of the vacuum-molded polyethylene gallery structure of FIG. 3.
Figure 6:
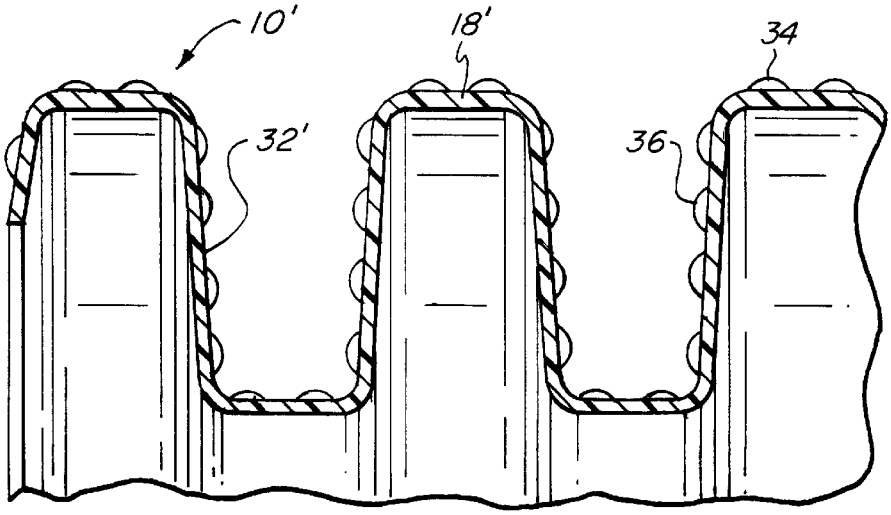
FIG. 6 is a partially cross-sectional view of the embodiment of the vacuum-molded polyethylene gallery structure shown in FIG. 4.
Figure 7:
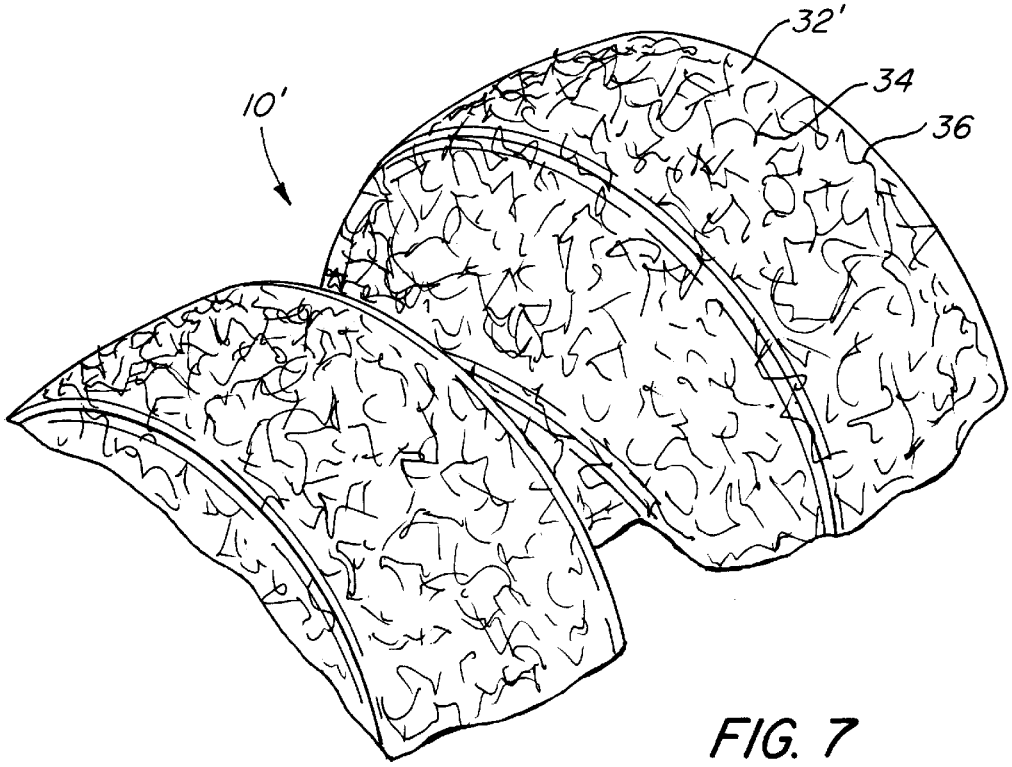
FIG. 7 is an enlarged perspective view showing in more detail another embodiment of the vacuum-molded polyethylene gallery structure of FIG. 3.

Protuberances 36 and dimples 38 may have any of numerous shapes. For example, protuberances 36 and dimples 38 may have a regular geometric shape, such as being hemispherical or semispherical (as shown in FIGS. 4–6), polyhedral, conical, frustoconical, etc. The surface area enhancing elements 34 can also comprise surface texturing (as shown in FIG. 7), which can be provided by a mold having scratches, pits, indents, etc. Moreover, surface area enhancing elements 34 may all be of substantially the same size (as shown in FIGS. 4–6), or the sizes thereof may vary (as shown in FIG. 7). Furthermore, surface area enhancing elements 34 may be regularly (as shown in FIGS. 4–6) or irregularly (as shown in FIG. 7) spaced.

Figure 3:
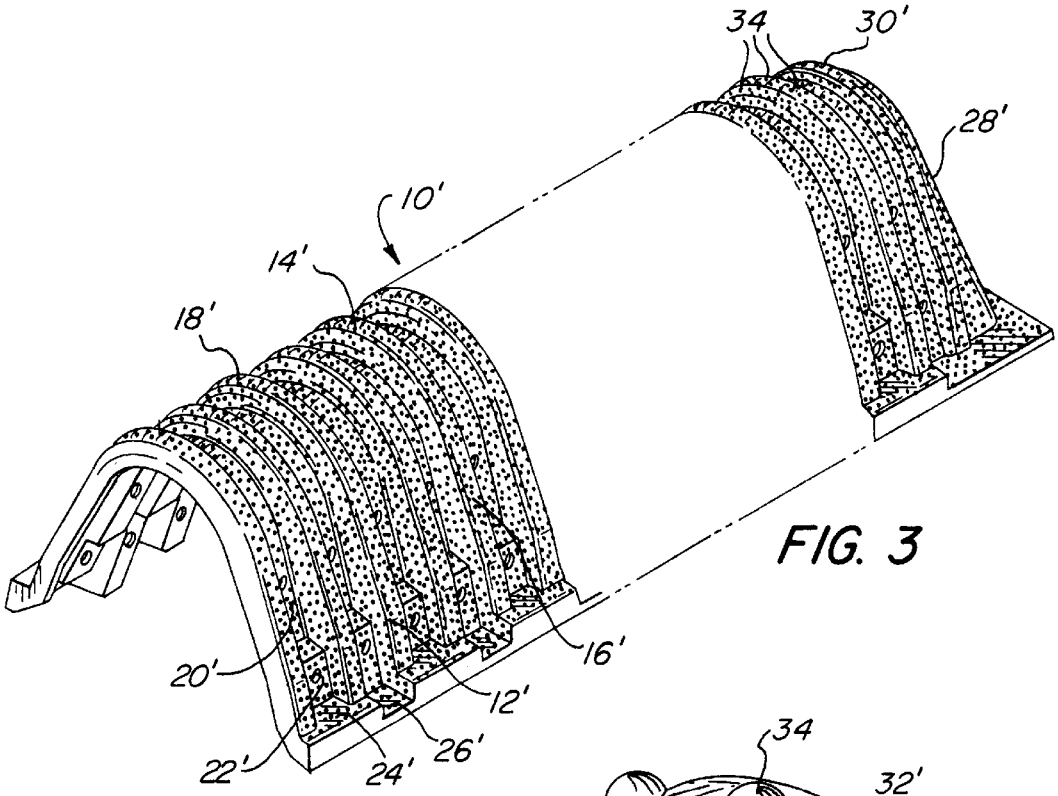
FIG. 3 is a perspective view of a vacuum-molded polyethylene gallery structure in accordance with the present invention.

As will be understood by those skilled in the art, and as can be most easily seen in FIGS. 3, 6 and 7 providing surface area enhancing elements 34 increases the surface area of outer surface 32' so as to create a larger surface area on which beneficial bacteria and other microorganisms can colonize and flourish, thereby increasing the decomposition of waste within the leaching or drainage system.

When galleries 10' are formed by a molding process, protuberances 36 and/or dimples 38 can be easily created therein simply by providing the molds used to create galleries 10' with dimples (in order to create protuberances 36 in the molded gallery 10') and/or with protuberances (in order to create dimples 38 in the molded gallery 10'). It is also easy to create a textured surface having a random pattern (as shown in FIG. 7) by sandblasting the mold, thereby creating a random textured pattern in the mold which would result in a random pattern of surface area enhancing elements 34 in the molded gallery 10', and/or by randomly depositing material in the mold, thereby creating a random pattern of surface elements in the mold which would result in a random pattern of surface area enhancing elements 34 in the molded gallery 10'.

The present invention, therefore, provides a leaching field system which employs lightweight vacuum-molded polyethylene gallery structures to form the leaching field, which may be readily and economically fabricated and will enjoy a long life in operation, which is resistant to being crushed by weight above it, which promotes the growth and flourishing of the bacteria and other microorganisms entering the leaching field, and which is provided with a maximized surface area to so promote the growth and flourishing of the bacteria and other microorganisms.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A gallery for guiding liquid through a leaching or drain field and allowing liquid to seep into adjacent ground comprising:

an elongated main body portion having an undulating wall defined by a plurality of laterally spaced apart ribs, the undulating wall defining an outer surface and an interior space for liquid and particles to flow therethrough; and a plurality of surface area enhancing elements formed on the outer surface of the undulating wall on and between the ribs for increasing a surface area of the outer surface to promote the growth and flourishing of the bacteria and other microorganisms on the outer surface.

2. The gallery of claim 1 wherein the undulating wall has a plurality of holes passing therethrough for allowing liquid and particles to escape from the interior space into the leaching or drain field.

3. The gallery of claim 1 wherein the surface area enhancing elements comprise protuberances.

4. The gallery of claim 1 wherein the surface area enhancing elements comprise dimples.

5. The gallery of claim 1 wherein the surface area enhancing elements comprise surface texturing.

6. The gallery of claim 1 wherein the surface area enhancing elements comprise protuberances, dimples, surface texturing or a combination of two or more thereof.

7. The gallery of claim 1 wherein the surface area enhancing elements comprise regular geometric shapes.

8. The gallery of claim 7 wherein the shapes of the surface area enhancing elements are selected from the group consisting of hemispherical, semispherical, polyhedral, conical, frustoconical and combinations of these.

9. The gallery of claim 1 wherein the surface area enhancing elements comprise irregular shapes.

10. The gallery of claim 1 wherein the surface area enhancing elements are all of substantially the same size.

11. The gallery of claim 1 wherein the surface area enhancing elements are randomly sized.

12. The gallery of claim 1 wherein the surface area enhancing elements are regularly spaced.

13. The gallery of claim 1 wherein the surface area enhancing elements are randomly spaced.

14. A gallery for guiding liquid through a leaching or drain field and allowing liquid to seep into adjacent ground comprising:

an elongated main body portion having an undulating wall defined by a plurality of laterally spaced apart ribs, the undulating wall defining an outer surface and an interior space for liquid and particles to flow therethrough, the undulating wall having a plurality of holes passing therethrough for allowing liquid and particles to escape from the interior space into the leaching or drain field; and a plurality of protuberances, dimples, textured surfaces or a combination thereof formed on the outer surface of the undulating wall on and between the ribs for increasing a surface area of the outer surface to promote the growth and flourishing of the bacteria and other microorganisms on the outer surface.

15. A leaching or drain field for guiding liquid through and allowing liquid to seep into adjacent ground, the leaching or drain field being formed from a plurality of gallery segments, each of the gallery segments comprising:

an elongated main body portion having an undulating wall defined by a plurality of laterally spaced apart ribs, the undulating wall defining an outer surface and an interior space for liquid and particles to flow therethrough;

a plurality of surface area enhancing elements formed on the outer surface of the undulating wall on and between the ribs for increasing a surface area of the outer surface to promote the growth and flourishing of the bacteria and other microorganisms on the outer surface; and wherein said gallery segment is connected to at least one adjacent gallery segment.

* * * * *